US005839121A

United States Patent [19]

Morales

[11] Patent Number: 5,839,121

[45] Date of Patent: Nov. 24, 1998

[54] CAP OR HELMET FOR COOLING THE SCALP

[76] Inventor: Luis O. Laboy Morales, Estancias De San Benito #620, Mayaguez, Puerto Rico, 00680

[21] Appl. No.: 75,200

[22] Filed: May 11, 1998

Related U.S. Application Data

[60] Provisional application No. 60/046,304 May 13, 1997.

[51] Int. Cl.[6] ..... A42B 3/28

[52] U.S. Cl. ..... 2/7; 2/209.7; 2/425; 2/DIG. 1

[58] Field of Search ..... 2/7, 171.2, 171.3, 2/181, 181.2, 181.6, 182.1, 182.3, 182.7, 182.8, 209.3, 209.5, 209.7, 425, DIG. 1

[56] References Cited

U.S. PATENT DOCUMENTS

D. 275,334 9/1984 Pullin .
4,115,874 9/1978 Hasegawa .
4,455,687 6/1984 Johansson .
4,484,363 11/1984 Varanese .
4,731,885 3/1988 Nava .
5,163,425 11/1992 Nambu et al. .
5,337,421 8/1994 Jeng .
5,353,605 10/1994 Naaman .
5,425,620 6/1995 Stroud .
5,696,356 12/1997 Dudley et al. ..... 2/425

*Primary Examiner*—Diana L. Biefeld
*Attorney, Agent, or Firm*—Richard C. Litman

[57] ABSTRACT

A cooling cap or helmet containing at least one and, ordinarily, several air funnels which ventilate a sportsman's scalp during the sports activity, e.g., running or jogging, cycling, etc. The air funnels have downward flow through apertures or through ducts. The flexible funnels can be removed for cleaning or replacement. An added advantage is the massaging of the scalp during the use of the air funnel containing cap or helmet.

11 Claims, 2 Drawing Sheets

CAP OR HELMET FOR COOLING THE SCALP

CROSS-REFERENCE TO RELATED APPLICATION

This application claims the benefit of U.S. Provisional Patent Application Ser. No. 60/046,304, filed May 13, 1997.

BACKGROUND OF THE INVENTION

1. Field of the Invention

The present invention relates to a cap or helmet for air cooling the scalp, during sports activity, particularly.

2. Description of Related Art

The relevant art describes various hats and helmets which are cooled by various means. The relevant art will be described in the order of their perceived relevance to the present invention.

U.S. Pat. No. 4,115,874 issued on Sep. 26, 1978, to Masahiro Hasegawa describes a motorcycle helmet. The hard helmet is molded with three parallel grooves with several holes in each groove and a central outlet in the tail portion. The helmet is lined with a flexible "bumping" shell of polystyrene or cork and a sponge covering (next to the scalp) having streamlined parallel recesses aligned to pass the incoming air from the wind collecting funnel to the rear of the helmet. The front openings can number from one up to many and lead into an increased number of recesses which exit in several outlets. There is no suggestion for providing specific outlets from the recesses to the immediate scalp area except possibly for the porosity of the spongy layer which is optional. In any event, the air from the scalp region would be passing into the recesses through the spongy layer under the Bernoulli effect and out the rear outlets, which effect is just the opposite of the present invention.

U.S. Pat. No. 4,455,687 issued on Jun. 26, 1984, to Sven O. G. Johansson describes a head cover and a safety helmet for a sand blaster person or a spray painter, said head cover having a detachable air hose and a removable filter collar. The internal air hose has a perforated loop over the head and is connected to an external air supply source not shown. There is no teaching that the flowing air is for cooling of the person's head.

U.S. Pat. No. 5,337,421 issued on Aug. 16, 1994, to Yen-Ming Jeng describes a molded cyclist helmet with three parallel external grooves with several holes in each groove. The central groove ends in an outlet at the tail of the helmet. The interior of the helmet is also grooved with oblique air conducting grooves passing from the outside external grooves to the center groove. There is no suggestion for adding closed channels which direct or remove air from the scalp as in the present invention.

U.S. Pat. No. 4,731,885 issued on Mar. 22, 1988, to Pier L. Nava describes a device to direct air flow on a grated helmet visor into the helmet and laterally along the visor by manipulation of two hinged valves. There is no suggestion for further directing the air into the scalp region by separate passageways.

The following patents describe other cooling apparatus for hats, which references are distinguished by their mechanized air flow or non-air flow characteristics.

U.S. Pat. No. 4,484,363 issued on Nov. 27, 1984, to Teresa E. Varanese describes a hat having a removable cooling device mounted in the front inside portion. A pocket stores a sealed container filled with a coolant.

U.S. Pat. No. 5,353,605 issued on Oct. 11, 1994, to Chibbi Naaman describes a headwear which completely covers the head and is supplied with a source of cooled air.

U.S. Pat. No. 5,425,620 issued on Jun. 20, 1995, to Kevin J. Stroud describes a hat with a battery driven electric fan mounted on the brim or the crown of a cap.

Design U.S. Pat. No. 275,334 issued on Sep. 4, 1984, to Fred L. Pullin describes a hard hat with a solar-powered cooling fan.

U.S. Pat. No. 5,163,425 issued on Nov. 17, 1992, to Masao Nambu et al. describes a deformable cap for scalp cooling obtained by incorporating hydrogel pieces of polyvinyl alcohol and optionally a glycol additive in a plastic ball, forming a cap and freezing.

None of the above inventions and patents, taken either singly or in combination, is seen to describe the instant invention as claimed.

SUMMARY OF THE INVENTION

Sport activities such as running or jogging, baseball, football, bicycling, roller blading, motorcycling or the like require removal of the hat or helmet to counteract the overheating of the sportsman's head. The present invention permits the air cooling during the sustained activity by multiple funnels in the hat or helmet to eliminate the need for removal of the hat or helmet during the activity. Another advantage resides in the massaging effect of the cooling apparatus by provision of scalp massaging ducts in the multiple funnels. The air cooling apparatus can be removed for cleaning.

Essentially, the invention is cooling cap or helmet with air funnels to ventilate a sportsman's scalp during athletic activity. The air funnels have downwardly directed, flow-through apertures or through-ducts. The flexible funnels are mounted in uncomplicated fashion so as to be removable. The added advantage, as stated above, is the massaging of the scalp during the use of the invention. Although two funnels are shown and taught, conceivably just one would suffice.

Accordingly, it is a principal object of the invention to provide an air cooled hat or helmet for sports activities.

It is another object of the invention to provide an air cooled hat or helmet which distributes the moving air directly to the scalp.

It is a further object of the invention to provide an air cooled hat or helmet with air funnel element(s) which (is) are adjustable in length and removable for cleaning.

Still another object of the invention is to provide an air cooled hat or helmet with air funnel elements having perforations directed to the scalp region with or without air ducts.

Yet another object of the invention is to provide the opening elements with insect blocking screens.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention provides a cooling head cover for sports wherein the problem of overheating is mitigated by installing ventilating funnels with a series of apertures or ducts.

Figure 1:
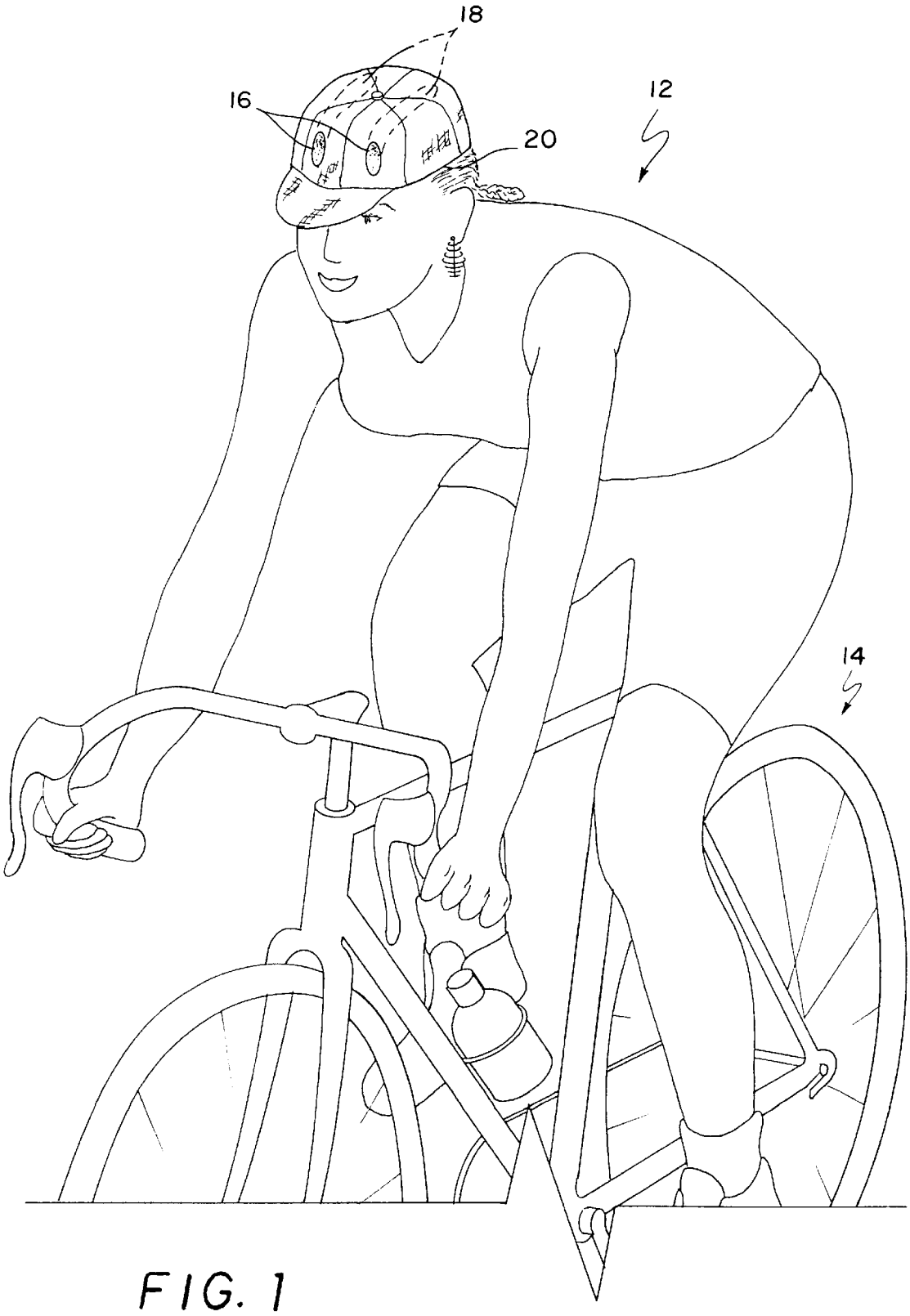
FIG. 1 is an environmental perspective front view of a cyclist on a bicycle partly shown with the air cooling tubes partly in shadow.

FIG. 1 depicts the head cover or cap 10 being worn by a cyclist 12 traveling on a bicycle 14 at a respectable speed in order to cause the air to flow through the two opening elements 16 in the cap 10 into the funnel body elements 18 (shown in shadow) and onto the scalp 20. The number of opening elements 16 and funnel body elements 18 can vary from two to three depending on the size of the hat or helmet and on the preference of the wearer. A fabric or plastic screen cover (not shown) over the opening elements 16 would be beneficial for preventing the entrance of insects. The head cover can be a cap or a helmet for sports such as baseball, football, field or ice hockey, lacrosse, soccer, handball, motorcycling, bicycling, and the like to provide enhanced cooling during the athlete's motion and consequently the athlete's performance.

Figure 2:
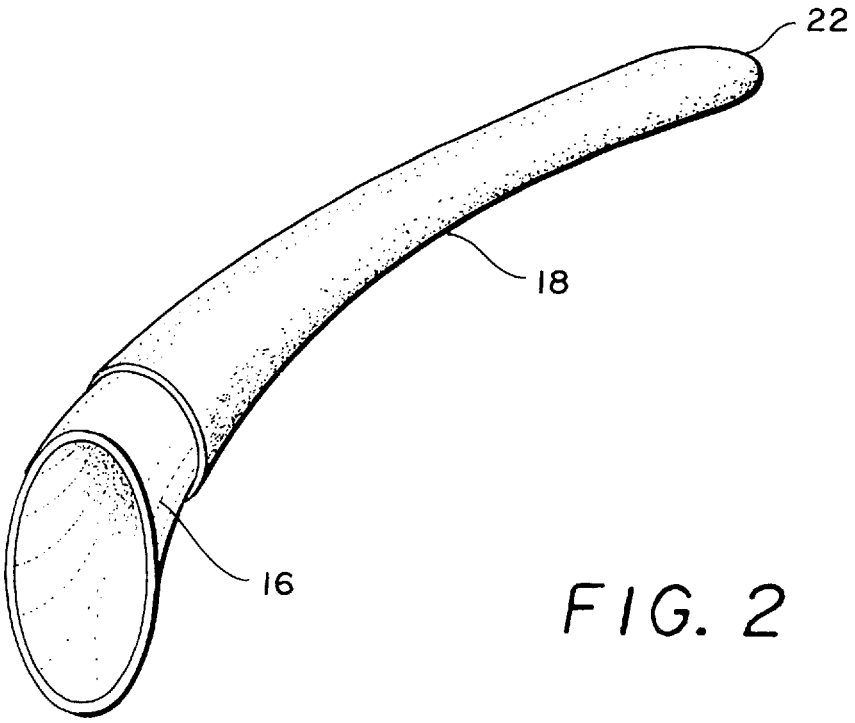
FIG. 2 is a perspective view of a first embodiment of a telescopic funnel with extension tubes.

FIG. 2 illustrates a first embodiment of the present invention wherein six pairs of flexible extension tubes or ducts 17 project from each funnel body element 18, thereby actually causing beneficial contact of the ducts with the scalp during movement of the person using this head cover. A circular opening element 16 of a larger diameter telescopes into to the funnel body element 18 which decreases in diameter to the closed end 22. The telescoping parts enable adjustment of the elements 16 and 18 to any size head cover 10. The elements 16 and 18 can then be attached to the inside of the head cover 10 by any attachment means which allow removal such as hook and loop material, stitching, strapping or the like. The elements 16, 18 and the extension tubes 17 can be made of flexible plastic or rubber which can be readily removed if desirable for cleaning.

Figure 3:
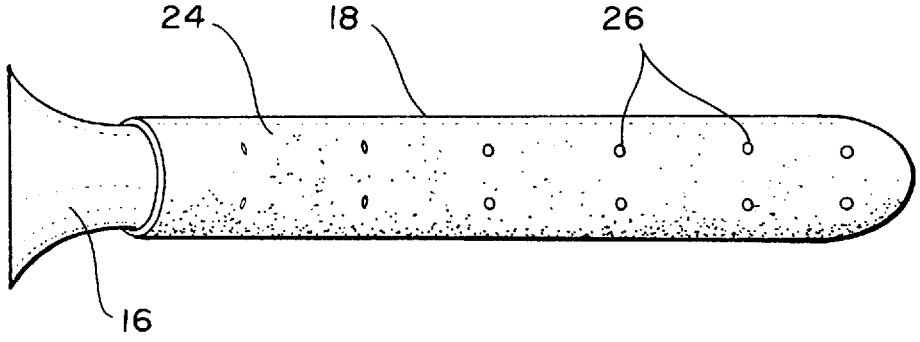
FIG. 3 is bottom view of a second embodiment of a telescopic funnel with funnel apertures.

FIG. 3 is a second embodiment of the present invention showing the underside surface 24 of the elements 16, 18, wherein element 18 has a series of apertures 26 arranged in any suitable design such as the two rows depicted. The forced flow of air through these apertures 26 ventilate and massage the scalp to alleviate any overheating of the scalp due to the exertion of the wearer.

It is to be understood that the present invention is not limited to the embodiments described above, but encompasses any and all embodiments within the scope of the following claims.

I claim:

1. A cooling head cover comprising:

a head cover selected from the group consisting of a cap and a helmet, the cover having a front surface;

at least one large opening element in a selected surface of said head cover; and a flexible funnel element extending from said at least one large opening element, said flexible funnel narrowing in diameter and being closed at an opposite end;

said funnel element having means defining a series of apertures defined through its lower surface, whereby upon locomotion of the user wearing the head cover, the apertures of said at least one funnel ventilate and massage the scalp.

2. The cooling head cover according to claim 1, including at least one duct leading from the apertures, arranged and configured to physically massage the scalp and trespass the barrier that hair poses for direct scalp ventilation.

3. The cooling head cover according to claim 1, including a fabric cover for covering the said at least one large opening element.

4. The cooling head cover according to claim 1, wherein said large opening is located in said front surface of said head cover.

5. The cooling head cover according to claim 1, wherein said head cover is a cap.

6. The cooling head cover according to claim 1, wherein said head cover is a helmet.

7. A cooling head cover comprising:

a head cover selected from the group consisting of a cap and a helmet, the cover having a front surface;

at least two large opening elements in said front surface of said head cover; and a flexible funnel element extending from each said opening element, each flexible funnel being parallel to the other, narrowing in diameter and being closed at an opposite end;

each funnel element having means defining a series of apertures in its lower surface, whereby upon locomotion of the user wearing the head cover, the apertures of said at least two funnels ventilate and massage the scalp.

8. The cooling head cover according to claim 7, including ducts leading from the apertures, arranged and configured to physically massage the scalp and trespass the barrier that hair poses for direct scalp ventilation.

9. The cooling head cover according to claim 7, including a fabric cover for covering the said at least two opening elements.

10. The cooling head cover according to claim 7, wherein said cooling head cover is a cap.

11. The cooling head cover according to claim 7, wherein said cooling head cover is a helmet.

* * * * *